US005573594A

United States Patent [19]

Morikawa et al.

[11] Patent Number: 5,573,594

[45] Date of Patent: Nov. 12, 1996

[54] COATING APPARATUS AND MACHINING METHOD THEREFOR

[75] Inventors: Masahiro Morikawa; Hideaki Usui; Kimiaki Miyamoto, all of Kanagawa, Japan

[73] Assignee: Fuji Photo Film Co., Ltd., Kanagawa, Japan

[21] Appl. No.: 246,718

[22] Filed: May 20, 1994

[30] Foreign Application Priority Data

May 31, 1993 [JP] Japan ..... 5-129051

[51] Int. Cl.[6] ..... B05C 3/12

[52] U.S. Cl. ..... 118/410; 118/419

[58] Field of Search ..... 118/410, 411, 118/419, DIG. 2, DIG. 4; 425/461

[56] References Cited

U.S. PATENT DOCUMENTS

| | | | |
|---|---|---|---|
| 2,761,791 | 9/1956 | Russell . | |
| 3,755,523 | 8/1973 | Straub et al. | 425/465 |
| 4,828,779 | 5/1989 | Hiroki et al. | 118/411 |
| 5,004,628 | 4/1991 | Terai et al. | 427/389.9 |

FOREIGN PATENT DOCUMENTS

| | | |
|---|---|---|
| 0435351 | 12/1990 | European Pat. Off. . |
| 0484980 | 11/1991 | European Pat. Off. . |
| 530032 | 12/1972 | Germany . |
| 3045787 | 7/1982 | Germany . |
| WO9222418 | 12/1992 | WIPO . |

*Primary Examiner*—Brenda A. Lamb
*Attorney, Agent, or Firm*—Sughrue, Mion, Zinn, Macpeak & Seas

[57] ABSTRACT

In a coating apparatus where a coating composition is supplied from the lateral side of a manifold, a linear or curved taper along the width of the coating apparatus is given to the length a slit in the direction of flowing-out of the coating composition, so that the slit length is shorter in the counter-supply side than in the supply side of the manifold. The coating apparatus can make the distribution of the quantity of coating uniform in the case where the width of coating is large, or in the case where the quantity of flow per unit width in an individual layer is large.

1 Claim, 3 Drawing Sheets

FIG. 5
PRIOR ART
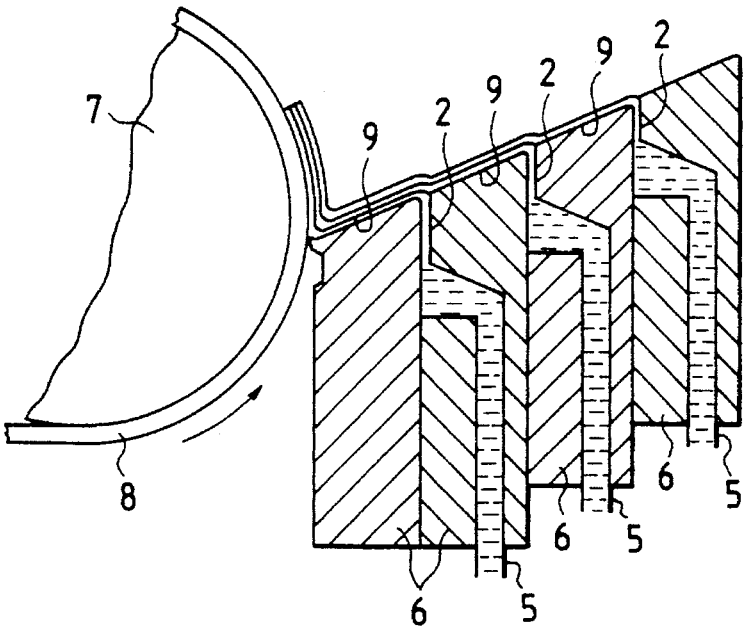
FIG. 6
PRIOR ART
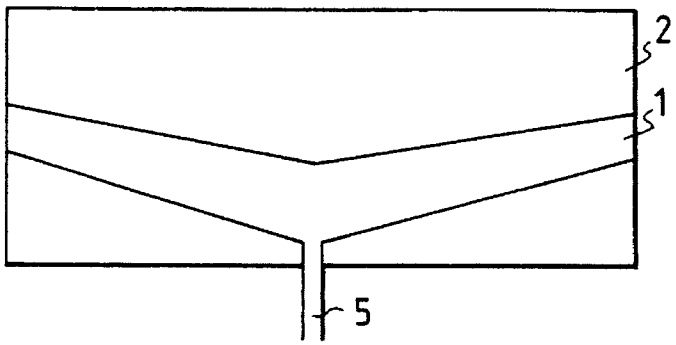
FIG. 7(a)
FIG. 7(b)
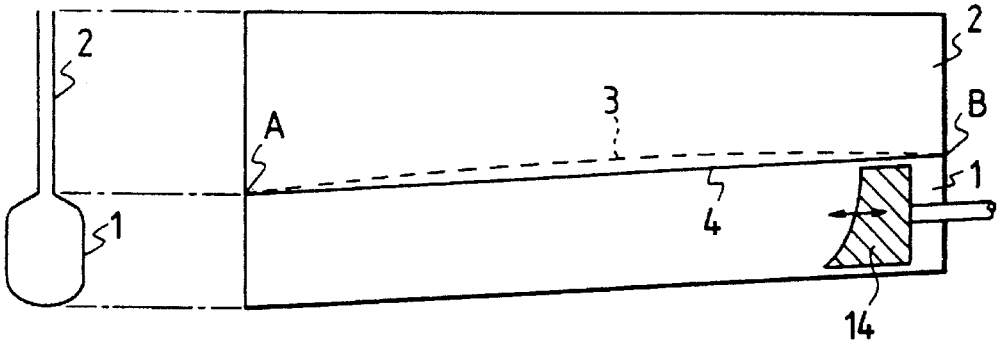

COATING APPARATUS AND MACHINING METHOD THEREFOR

BACKGROUND OF THE INVENTION

The present invention relates to an apparatus for coating a continuously moving web having the form of a belt-like carrier with various liquid coating compositions, for use in the production of a photographic light-sensitive film, a photographic paper, a magnetic recording tape, an adhesive tape, information recording paper such as a pressure sensitive paper, a thermo-sensitive paper or the like, a light-sensitive printing plate, and so on. The present invention further relates to a method of performing machining on a block constituting the coating apparatus.

A basic structure of an apparatus according to a slide bead system for coating a plurality of layers at the same time with several liquid compositions is disclosed in U.S. Pat. No. 2,761,791. FIG. 5 is a sectional view of a typical coating die used in this field, particularly for coating a web with photographic light-sensitive materials.

A coating composition supplied from a liquid inlet 5 is spread widthwise in a manifold 1 (a portion where the coating composition is spread widthwise in the coating die). Then a layer of the coating composition is formed by a slit 2 (a portion which is on the downstream side of the manifold and where a layer of the coating composition is formed). The formed layer of the coating composition flows on an inclined slide surface 9 and is applied on a web 8 supported by a backup roller 7. In this apparatus it is very important to use a coating die which can give an uniform distribution of the coating quantity.

If the speed of coating is increased or the width of coating is expanded in order to increase the quantity of production, it is inevitable that the quantity of supplied liquid is increased. Accordingly the dynamic pressure of liquid put into the manifold 1 from the liquid inlet 5 is so increased as to give an influence to a flow in the slit. Particularly near the liquid inlet 5, the dynamic pressure becomes so high that the distribution of coating quantity tends to be deteriorated, i.e. the uniformity of the liquid layer is disturbed. This deterioration is conspicuous in the case where the quantity of flow of a coating composition exceeds 0.5 cc/cm.s per unit width.

The influence of the dynamic pressure may be reduced if the clearance of the slit 2 is made narrow to increase the pressure drop. In this case, however, if the mechanical accuracy of the slit clearance is not high enough, there occurs a defect that the unevenness of the slit clearance per se gives an influence directly to the distribution of coating quantity more and more as the slit is made narrower. There is another means in which the liquid inlet 5 is enlarged in order to reduce the dynamic pressure per se. In this case, however, the thickness of a block 6 becomes so large that, in the case of multi layer coating apparatus, there is produced a problem that a coating equipment as a whole becomes large, and at the same time the weight thereof is increased remarkably.

Although a number of patents concerning bead-coating show various shapes of coating dies, most of them adopt a method to supply liquid to a manifold from the center of the die, that is, a center-feed method, and they have potentially the above-mentioned problems.

As a factor which influences the distribution of coating quantity in connection with the fluidity of liquid, there is the pressure drop of a flow other than the above-mentioned dynamic pressure.

In order to eliminate the influence of the dynamic pressure, there is a method of supplying a liquid from a side of the block (a side-feed method) so that the direction of flow in the slit 2 is made perpendicular to the direction of liquid flow the manifold 1. However, the method has a defect in that the uniformity of coating quantity is deteriorated by the pressure drop of the flow in the manifold 1. (This non-uniformity is proportional to substantially the square of the coating quantity.)

Particularly such a problem appears conspicuously in the case where the width of coating is large, for example, beyond 2 meters.

In order to reduce this non-uniformity a method of making the length of a slit shorter in the widthwise flow direction has been used in an casting die for high viscosity liquid, or the like. (FIG. 6) (For example, "Design of Extrusion Die" translated by Tateyo Hayashida, published by The Japan Association of Plastics and Molding Engineers, or "Extrusion Technique for Plastic Sheet" written by Kimimasa Ito, published by Kogyo Chosakai Publishing Co., Ltd.)

This slit length profile indeed has an effect to a casting die for flowing a high-viscosity solution, but in the case of a coating composition of light sensitive material having a comparatively low viscosity (up to 200 4 cp), the distribution of dynamic pressure is not uniform enough when the quantity of flow is increased, so that the distribution of coating quantity is extremely deteriorated. Therefore the profile is not suitable for practical use.

There is a further method of enlarging a hydrodynamically equivalent diameter of a manifold in order to reduce the pressure drop. However, this method increases a liquid reserving volume so that there is a risk of troubles caused by agglomeration of a coating composition, and so on. In addition, it is necessary to make each block thick, so that there is a problem that the weight of the coating apparatus as a whole is increased.

SUMMARY OF THE INVENTION

It is therefore an object of the present invention to solve the foregoing problems pertaining to the prior art, and to provide a coating die by which the distribution of coating quantity can be made uniform.

Particularly, it is an object of the present invention to provide a coating die by which the distribution of coating quantity can be made uniform (specifically within 2%) in the case where the width of coating exceeds 2 meters, or even in the case where the quantity of flow per unit width in one layer exceeds 0.5 cc/cm.s, and to provide a machining method for such a coating die in which the distribution of coating quantity is improved.

The foregoing objects of the present invention are attained by:

(1) A coating apparatus having a manifold for widthwise spreading a coating composition, and a slit for making the coating composition flow out while forming a layer of the coating composition all over the width of the manifold to thereby coat a continuously moving web with the coating composition flowed from the slit, characterized in that a liquid inlet of the coating composition is disposed in a side end of the manifold, and the length profile of the slit in the direction of flowing-out of the coating composition is made gradually shorter from the liquid inlet side toward the side opposite to the liquid inlet side; and (2) A coating-apparatus machining method for shaping a block constituting a coating apparatus having a manifold for widthwise spreading a coating composition, and a slit for forming a layer of the coating composition all over the width of the manifold, characterized in that the block is bent and fixed in a plane including a surface of the slit, or in a plane perpendicular to the surface of the slit, and an end surface of the manifold contacting with the slit is ground with a linearly reciprocating machining means, so that the slit length profile in the direction of flowing-out of the coating composition is changed into a curved shape along the direction of width of the coating apparatus.

BRIEF DESCRIPTION OF THE DRAWINGS

FIG. 5 is a sectional view of a coating unit of a conventional coating apparatus.

FIG. 6 is an explanatory diagram showing an example of the prior art, in which distribution is given to the slit length of a casting die.

FIG. 7(*a*) and 7(*b*) are sectional views of a coating die block showing another embodiment of the present invention having a sliding plug in a end of a manifold.

DETAILED DESCRIPTION OF THE PREFERRED EMBODIMENTS

The present invention will be described with reference to the drawings.

Figure 1A:
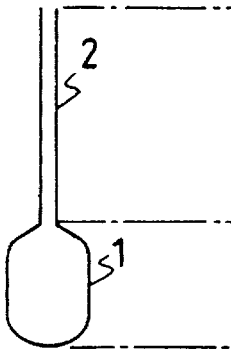
FIGS. 1(*a*) and 1(*b*) are sectional views of a coating die block showing an embodiment of the present invention, in which FIG. 1(*a*) is a side section and FIG. 1(*b*) is a front view.
Figure 1B:
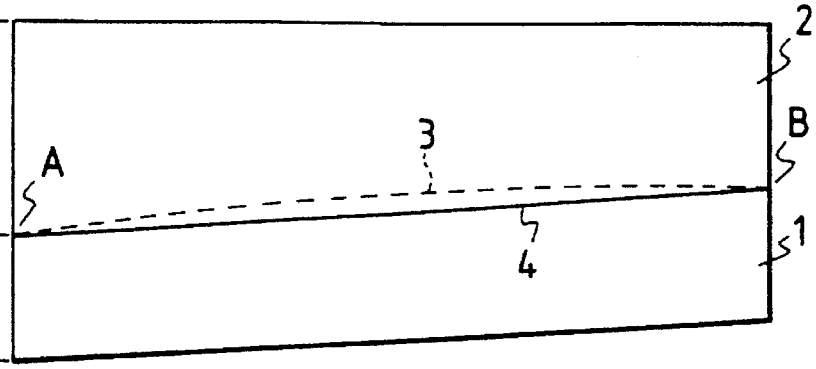
Figure 2:
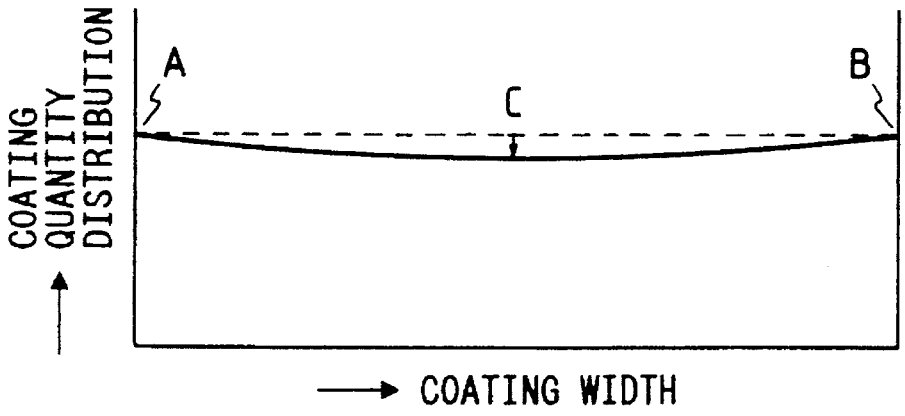
FIG. 2 is an explanatory diagram showing the tendency of the distribution of the quantity of coating in the case of using a linear taper.

FIGS. 1(*a*) and 1(*b*) show the coating die block of the present invention.

A coating composition is supplied from a lateral side in order to eliminate the influence of dynamic pressure, and the deterioration in distribution due to pressure loss of flow caused by widening the width is improved in a manner so that the slit length is linearly shortened from the supply side A toward the counter-supply side B as shown in a linear taper 4 of FIG. 1(*b*).

This method is effective enough if the width of coating is not so large. When the width of coating exceeds 2 meters, however, a problem occurs as follows. In the case where the slit length of the linear taper 4 is determined so that the quantity of coating in the supply portion A to a manifold is equal to that in the counter-supply portion B, the distribution of the quantity of coating in the intermediate portion C between the portions A and B is reduced because the distribution is inherently shaped into a downward parabola due to the pressure loss. In order to improve this phenomenon, the taper of the slit length may be made to be curved like a curved taper 3 shown in FIG. 1(*b*). Although the optimum curve is a parabola on calculation if the characteristics of fluidity of liquid are known, it is possible to easily estimate that there is enough of an effect even in the case where the curve is approximated to an arc or the like.

Figure 3:
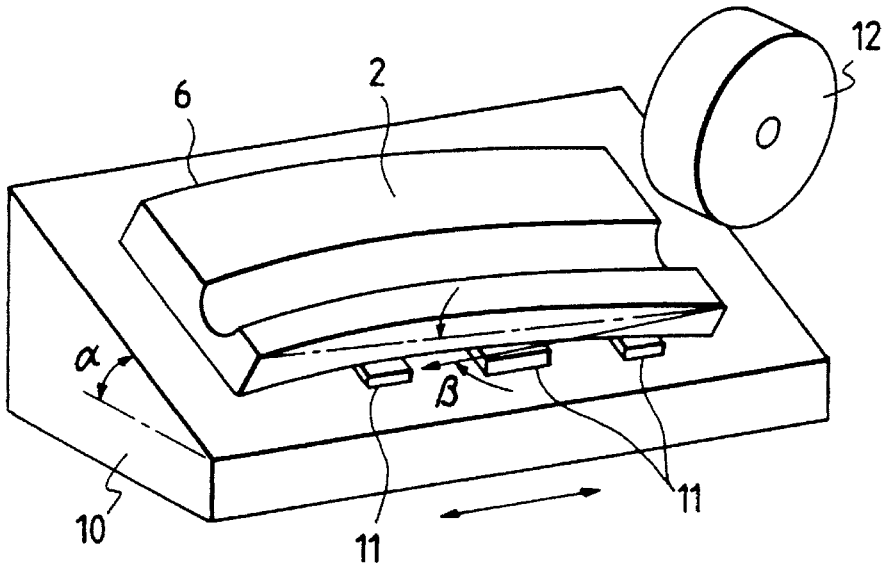
FIG. 3 is a schematic diagram illustrating a method of machining a coating machine block of the present invention. A method of machining the block while bending the block in a surface perpendicular to the surface of a slit.
Figure 4:
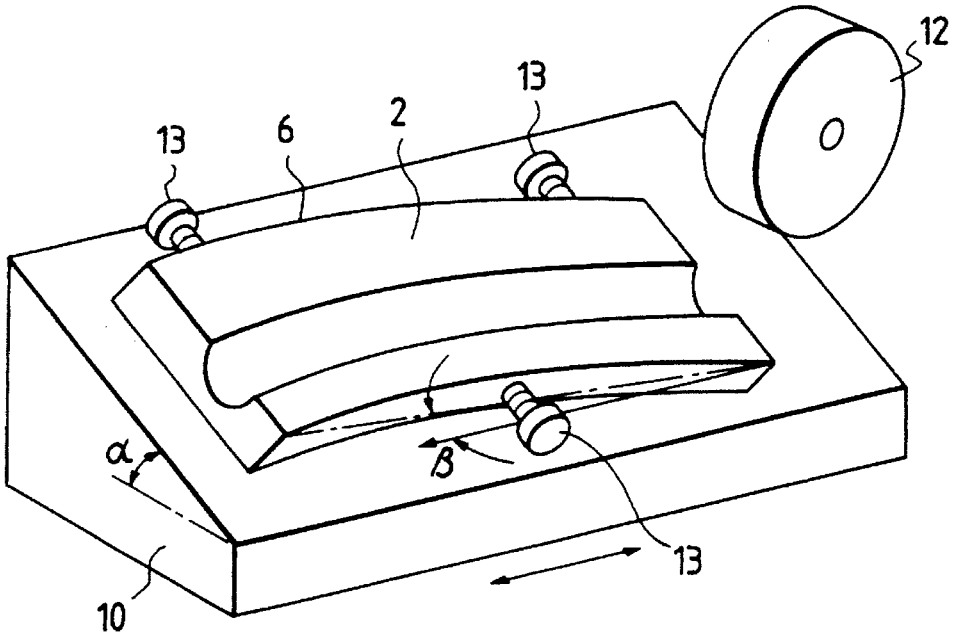
FIG. 4 is a schematic diagram illustrating another embodiment of the method of machining a coating machine block of the present invention. A method of machining the block while bending the block in a surface including the surface of a slit.

FIGS. 3 and 4 show the structure of the present invention utilized in connection with the process.

FIG. 3 shows a method of machining with a linearly reciprocating grind-stone 12, in which the machining is performed on a block 6 constituting a coating apparatus, the block 6 is bent in a plane perpendicular to the surface of a slit 2 which constitutes a part of the block 6, that is, bent and fixed in the direction of thickness of the block 6.

FIG. 4 shows a method of similar machining with a linearly reciprocating grind-stone 12, in which the block 6 is bent in the plane including the surface of the slit 2, that is, bent and fixed in the direction of width of the block 6. In each case, a bed 10 having a certain angle $\alpha$ is mounted on a table of a linearly reciprocating type working apparatus, and the block 6 is fixed and worked on the bed 10.

It is usual to put a block 6 on a bed 10, in the manner that its edge-line is slightly deflected from the machining direction, by an angle $\beta$ in horizontal plane, in order to make the slit length tapered. Wherein, the edge-line is defined as a straight line between the both end edges of the block 6, as shown in FIGS. 3 and 4. The sign of the angle $\beta$ can be either positive or negative in accordance with the direction to which the liquid supply side is pointing. The angle $\beta$ is decided by the required degree of the taper to be given to the slit length.

As shown in FIG. 3, a method in which spacers 11 having different thicknesses are put under a block 6 to thereby bend the block 6, and the block 6 is-ground with a grind-stone 12 while a table is reciprocated, is used in order to correct an undesired curve of material. This method is introduced, for example, in "Machining Handbook" (Machine Tool Study Meeting, published by Yokendo).

The present invention uses this method in order to intentionally give a curve to the slit length of the block 6.

Although a desired taper profile of the slit length is a parabola in theory, it is possible to perform optimization on design through the selection of the thickness and location of the spacers 11, for example, in such a manner that the parabolic profile is approximated to a practical shape, an arc, or the like.

FIG. 4 shows another method of the present invention, in which a block 6 put on a bed 10 in the same manner is ground while pushed and bent widthwise by use of push bolts 13. Also in this case, it is possible to select a preferable curved profile through consideration of the number and location of the push bolts 13.

According to each of the machining methods, shown in FIGS. 3 and 4, where the bed 10 is slanted by an angle of $\alpha$, on which the block 6 is bent and fixed, the boundary surface of the manifold 1 connecting with the surface of the slit 2 is ground by a linearly reciprocating grind-stone 12, and the curved profile of the slit length in the direction of flowing-out of the coating composition is attained as shown in a dashed curve 3 of FIG. 1(*b*) when the bending force to the block 6 is released after the machining.

The present invention can be combined with the changeable-coating-width configuration proposed in European Patent Number 0 530 751-A1. To apply this method to the present invention, either of the linear taper slit length configuration or the curved taper slit length configuration, it is necessary to make the cross-section of the manifold uniform, only in the range near the end of the counter-supply side where a plug is slidably inserted.

FIG. 7 shows an example of the present invention with the changeable-coating-width feature, where 14 is a sliding plug.

The "coating composition" used in the present invention includes various compositions to be selected according to the purposes in use thereof. For example, specific examples of the coating compositions include: coating compositions to be applied to light-sensitive emulsion layers, subbing layers, protective layers, back layers and so on in photographic light-sensitive materials; coating compositions to be applied to magnetic layers, subbing layers, lubricating layers, protective layers, back layers and so on in magnetic recording materials; and coating compositions to be applied to layers having microcapsules as main components, resin layers, matte layers and so on in information recording paper such as pressure sensitive paper, thermo-sensitive paper and the like.

The coating composition used in the present invention is not necessarily limited to be applied to Newtonian liquid but can be applied to Non-Newtonian liquid successfully.

The optimum profile of the slit length, even when the curved taper slit length is applied, can be found by a numerical calculation. The calculated curve is approximated by an arc or the like, without significant loss of the uniformity of the coated quantity.

Examples of the web used in the present invention include a paper web, a plastic film web, a metal web, a resin-coated paper web, a synthetic paper web, and so on. Examples of material for such a plastic film web include: polyolefins such as polyethylene, polypropylene, etc.; vinyl copolymers such as polyvinyl acetate, polyvinyl chloride, polystyrene, etc.; polyamides such as 6,6-Nylon, 6-Nylon, etc.; poluesters such as polyethylene terephthalate, polyethylene-2, 6-naphthalate, etc.; cellulose acetates such as cellulose triacetate, cellulose diacetate, etc.; polycarbonates; and so on.

Although polyolefins such as polyethylene and the like are typical examples of resin used for the resin-coated paper web, the resin is not limited to the specific examples. As a specific example of the metal web, there is an aluminum web.

EXAMPLES

Comparative Example 1

A coating die of the center-feed type as shown in FIG. 6 was used, and a gelatin solution of viscosity 40 cp was coated in flow quantity 0.8 cc/cm/s per unit width. Then the disturbance rate of the quantity of coating was about 5%.

Comparative Example 2

A coating die having slits equal to each other in length in the width direction was used, and coating was performed with the same liquid and the same flow quantity as those in Comparative Example 1. Then the disturbance rate of the quantity of coating was about 2.5%. This disturbance rate did not depend on the flow quantity, and the rate was almost the same even if the flow quantity was smaller.

EXAMPLE 1

A coating die of the side-feed type having a slit length profile provided with a linear taper 4 of FIG. 1(*b*) was used, and coating was performed with the same liquid and the same flow quantity. The taper was made about 3% shorter in the counter-supply side end portion than the slit length on the supply side.

As a result the disturbance rate of the quantity of coating was improved to about 1.5%.

EXAMPLE 2

A coating die having a slit length profile provided with a curved taper 3 of FIG. 1(*b*) was used, and coating was performed under the same conditions. In order to give the curved taper, a block was machined-in the method of FIG. 3, that is, bent and machined in the plane perpendicular to the surface of a slit. The angle $\alpha$ of a bed was 45 degrees, and spacers 100 to 300 μm thick were used as the spacers 11.

The slit length in the supply side end portion and in the counter-supply side end portion was made the same as in Example 1. In the intermediate area, a curve was given so that a taper on the counter-supply side was gentler than a taper on the supply side.

As a result the distribution of the quantity of coating was not more than 1%.

According to the present invention, liquid is supplied from side in order to eliminate the influence of the dynamic pressure of the liquid supplied to a coating unit, and the slit length is changed widthwise so as to compensate the increase of the pressure drop in a manifold. Accordingly, even if the width of coating exceeds 2 meters, or if the supply quantity per layer of a coating composition of viscosity not less than 30 cp exceeds 0.5 cc/cm.s, it is possible to obtain an uniform distribution of the quantity of coating. Needless to say, these means have effects in the improvement of the distribution of the quantity of coating even if the width is less than 2 meters, and the supply quantity is less than 0.5 cc/cm.s.

With use of the machining method of the present invention, it is possible to easily realize the shape of a curved taper approximating a desired slit length shape, that is, a parabolic shape of the-slit length.

What is claimed is:

1. A coating apparatus having a manifold defining a width and for widthwise spreading a coating composition, and a slit for making said coating composition flow out in a flowing-out direction while forming a layer of said coating composition all over the width of said manifold to thereby coat a continuously moving web with said coating composition flowed from said slit, wherein:

a liquid inlet of said coating composition is disposed in a lateral side of said manifold; and said slit has a length in the flowing-out direction of said coating composition which is made gradually shorter from said lateral side of said manifold in which said liquid inlet is disposed toward the side opposite to said liquid inlet, wherein said manifold and said slit share a common curved boundary which is upwardly convex so as to define a substantially tapered configuration of said slit in the flowing-out direction, said upwardly convex common curved boundary being parabolic in shape.

* * * * *